US007325682B2

(12) United States Patent
Seymour et al.

(10) Patent No.: US 7,325,682 B2
(45) Date of Patent: Feb. 5, 2008

(54) STORAGE CASE HAVING COVER OF TWO SLIDABLY-RELATED PORTIONS

(75) Inventors: Daniel R. Seymour, Mooresville, NC (US); Brandon C. Hoover, Cornelius, NC (US); Robert G. McRorie, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 309 days.

(21) Appl. No.: 10/907,684

(22) Filed: Apr. 12, 2005

(65) Prior Publication Data

US 2006/0226042 A1 Oct. 12, 2006

(51) Int. Cl.

| | |
|---|---|
| ***B65D 85/20*** | (2006.01) |
| ***B65D 79/00*** | (2006.01) |
| ***B65D 43/16*** | (2006.01) |
| ***B65D 5/50*** | (2006.01) |

(52) U.S. Cl. ..... 206/379; 206/743; 206/752; 206/754; 220/813

(58) Field of Classification Search ..... 206/372–373, 206/378–379, 745–749, 751–755; 220/811–815, 220/835–839, 4.22, 4.23

See application file for complete search history.

(56) References Cited

U.S. PATENT DOCUMENTS

| | | | | |
|---|---|---|---|---|
| 2,775,342 | A | | 12/1956 | Smith |
| 3,074,539 | A | | 1/1963 | Rogovin |
| 3,870,149 | A | | 3/1975 | Huot |
| 4,006,821 | A | | 2/1977 | Sautter |
| 4,150,746 | A | | 4/1979 | Buglione |
| D277,339 | S | | 1/1985 | Huot, Jr. et al. |
| 4,508,217 | A | * | 4/1985 | Long et al. ..... 206/753 |
| 4,512,467 | A | | 4/1985 | Knoblauch |
| 4,660,719 | A | | 4/1987 | Peterson et al. |
| 4,934,530 | A | | 6/1990 | Riess |
| 4,955,478 | A | | 9/1990 | Rau et al. |
| 4,958,732 | A | | 9/1990 | Rau et al. |
| 5,098,235 | A | | 3/1992 | Svetlik et al. |
| 5,148,914 | A | | 9/1992 | Budert et al. |
| 5,368,164 | A | | 11/1994 | Bennett et al. |
| 5,570,784 | A | | 11/1996 | Sidabras et al. |
| 5,628,400 | A | | 5/1997 | Feder |
| 5,669,492 | A | | 9/1997 | Chao |
| 5,746,316 | A | | 5/1998 | La Barre |
| D394,806 | S | | 6/1998 | Budert |
| 5,775,499 | A | | 7/1998 | Budert |

(Continued)

*Primary Examiner*—Bryon P. Gehman
(74) *Attorney, Agent, or Firm*—Dennis J. Williamson; Moore & Van Allen PLLC

(57) ABSTRACT

The storage case of the invention consists of a base and a mating cover. The cover is constructed of a first cover portion that is pivotably attached to the base and a second cover portion that is slidably retained on the first cover portion. To release the cover from the base, the second cover portion is moved to an extended position where the second cover portion is disengaged from the base. A plurality of drill bit cassettes hold the individual bits and are removably retained in a corresponding number of cassette holders located within the base. The cassette holders are connected to one another and to the cover such that when the cover is opened, the cassette holders are extended out of the base where they can be easily accessed. When the cover is closed the cassette holders are retracted into the base.

18 Claims, 6 Drawing Sheets

U.S. PATENT DOCUMENTS 5,813,533 A 9/1998 Knoblauch
5,829,596 A 11/1998 Budert
6,024,218 A 2/2000 Knoblauch
6,283,291 B1 9/2001 Vasudeva et al.
6,547,077 B1 4/2003 Budert
2004/0144671 A1 7/2004 Hallee et al.
2005/0211587 A1* 9/2005 Chen ..... 206/379

* cited by examiner

FIG. 5
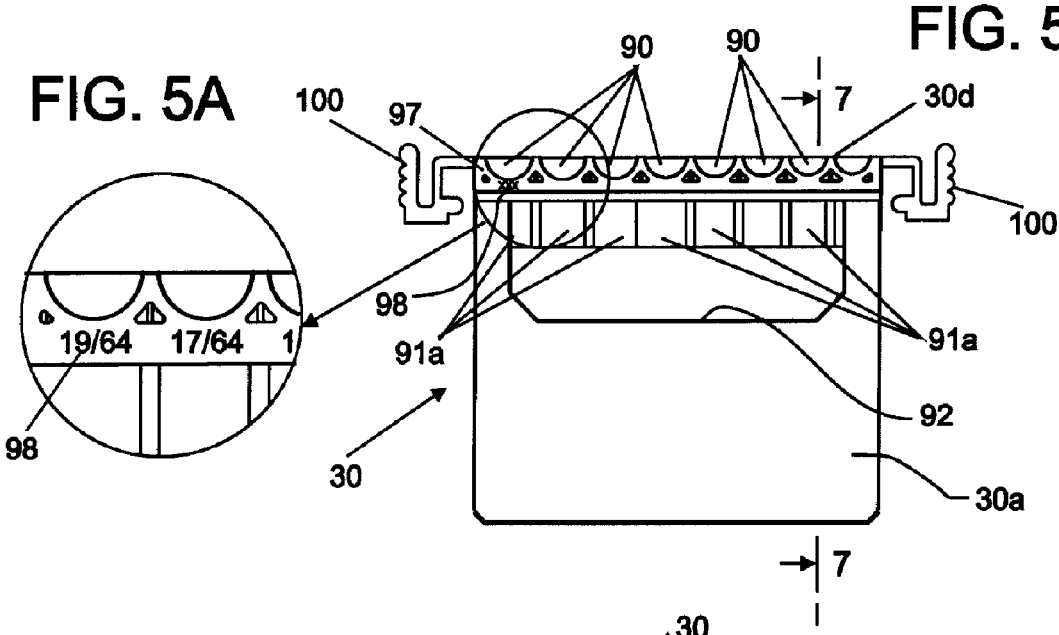
FIG. 5A
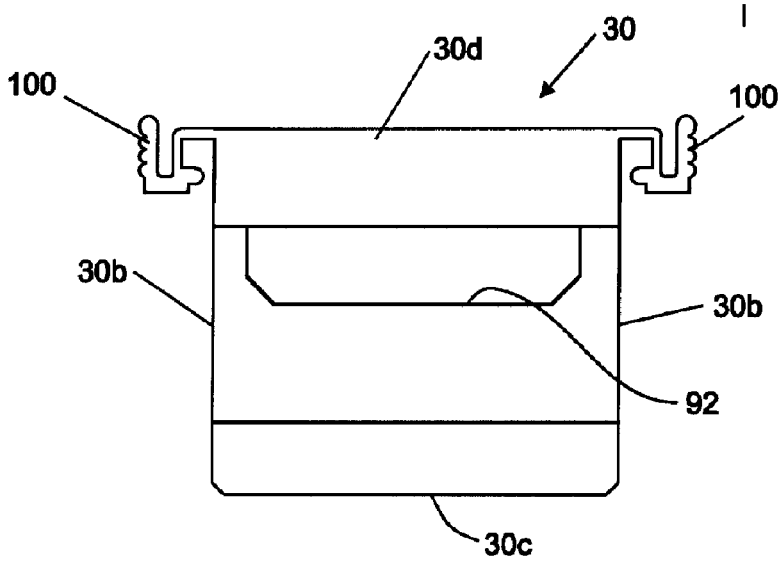
FIG. 6
FIG. 6A
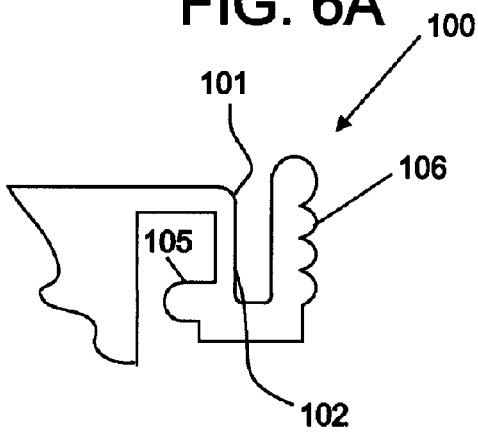
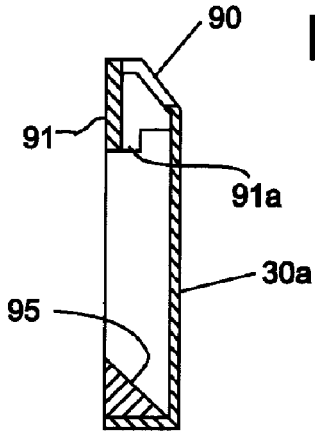
FIG. 7

STORAGE CASE HAVING COVER OF TWO SLIDABLY-RELATED PORTIONS

BACKGROUND

The invention relates generally to cases for storing articles and more particularly to a drill bit case that provides ready access to the stored bits.

As will be appreciated drill bits come in a wide variety of sizes defined by the diameter of the hole drilled by the bit. Drill bits are commonly sold and used as sets where a set includes a range of different sized bits. To retain and store the drill bits, cases are provided that typically consist of a bottom and top pivotably connected together to open and close in a clamshell arrangement. The cases commonly include retention members for holding the bits in predetermined locations inside the case. Because drill bits come in a wide variety of sizes and typical drill bit sets may include bits ranging in diameter from 1/16 to 1/2 inches in 1/64 inch increments, drill bits can be difficult to store in a manner that allows the user to quickly and easily access, remove and replace one bit or a group of bits from the case.

Thus an improved storage case that provides improved storage of and access to a plurality of drill bits is desired.

SUMMARY

The storage case of the invention consists of a base and a mating cover. The cover is constructed of a first cover portion that is pivotably attached to the base and a second cover portion that is slidably retained on the first cover portion. When the cover is closed, the second cover portion occupies a locked position where the second cover portion engages the base such that the cover is locked in the closed position. To release the cover from the base, the second cover portion is moved to an extended position where the second cover portion is disengaged from the base. In one embodiment when the cover is opened, the second cover portion moves to a third fully retracted position where the length of the cover is effectively shortened to facilitate access to the drill bits stored in the case. A plurality of drill bit cassettes hold the individual bits and are removably retained in a corresponding number of cassette holders located within the base. The cassette holders are connected to one another and to the cover such that when the cover is opened, the cassette holders are extended out of the base where they can be easily accessed. When the cover is closed the cassette holders are retracted into the base.

BRIEF DESCRIPTION OF THE DRAWINGS

FIG. 5 is a front view of a cassette used in the storage case of the invention.

FIG. 5A is a detailed front view of a portion of a cassette used in the storage case of the invention.

FIG. 6 is a back view of a cassette used in the storage case of the invention.

FIG. 6A is a detail view of a portion of the cassette used in the storage case of the invention.

FIG. 7 is a section view taken along line 7-7 of FIG. 5.

DETAILED DESCRIPTION OF EMBODIMENTS OF THE INVENTION

Figure 1:
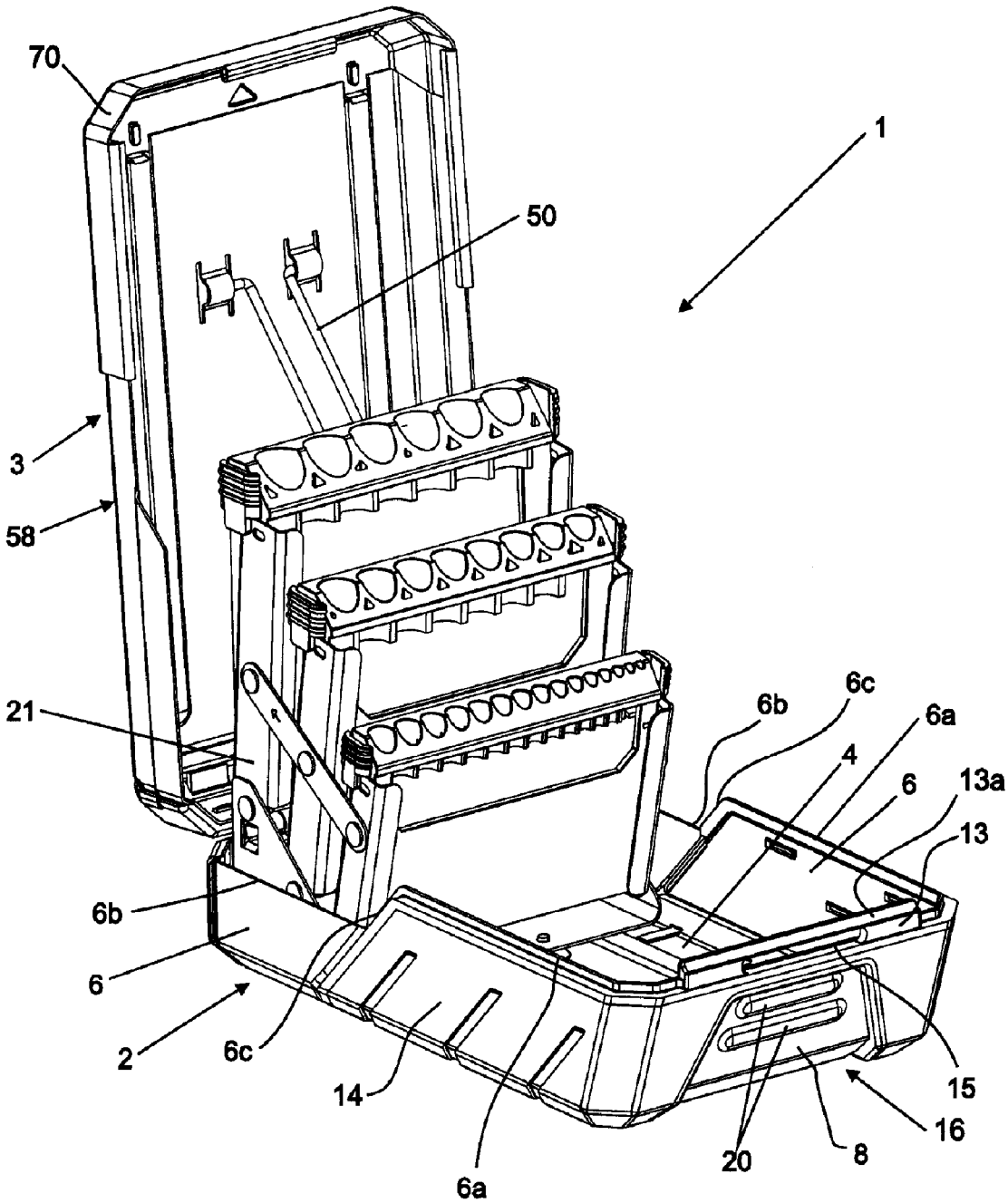
FIG. 1 is a perspective view of the storage case of the invention in the open position.
Figure 2:
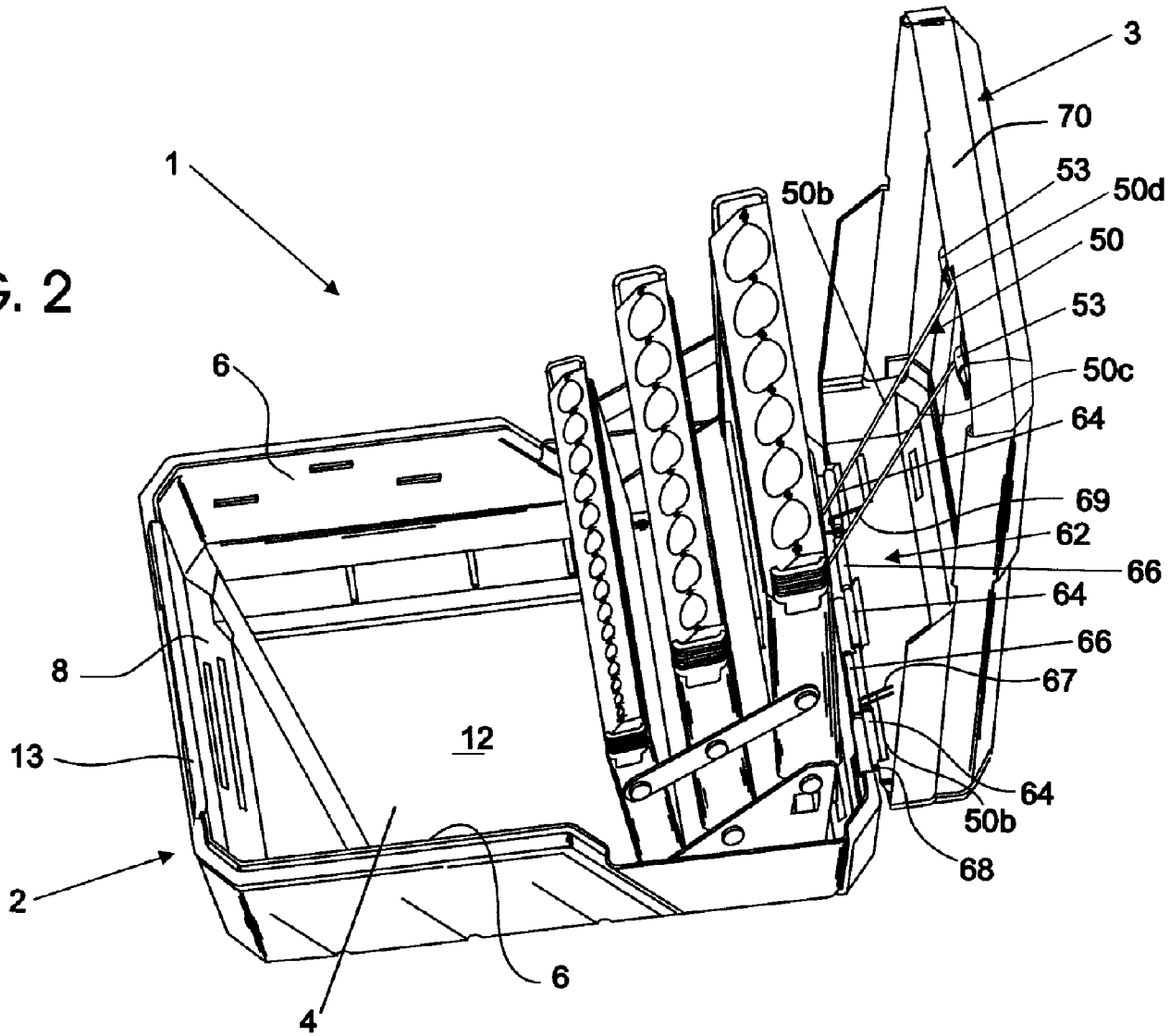
FIG. 2 is another perspective view of the storage case of the invention in the open position.
Figure 3:
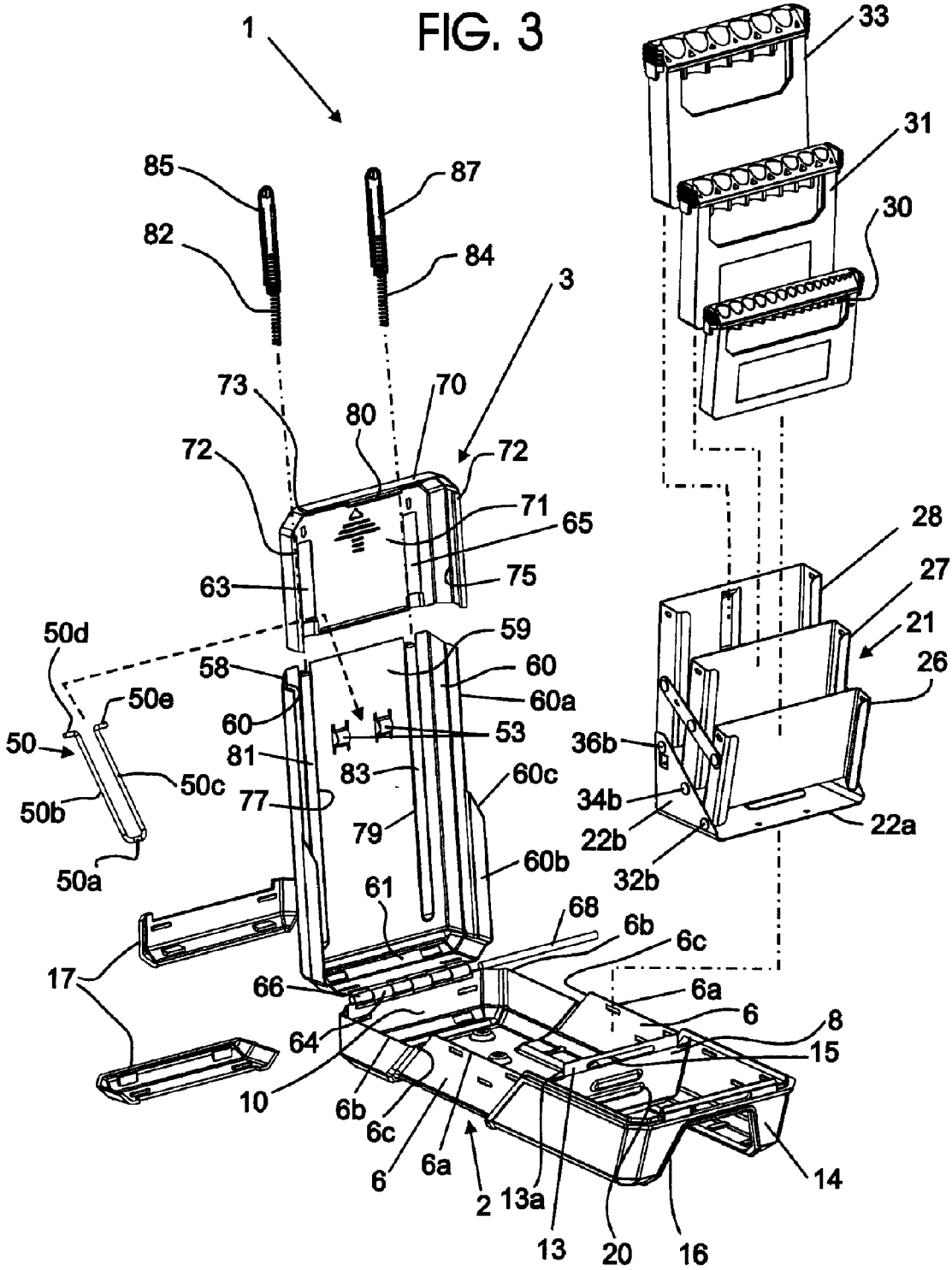
FIG. 3 is an exploded perspective view of the storage case of the invention.

Referring to FIGS. 1 to 3 the case of the invention is shown generally at 1 in an open state and consists of a base 2 and a cover 3. Both the case and cover may be made of die cast metal, aluminum, sheet metal or other rigid material. Base 2 has a planar bottom wall 4 and a pair of side walls 6, a front wall 8 and rear wall 10 extending from the bottom wall 4 to create an internal cavity 12. The front wall 8 includes an upstanding flange 13 that defines an aperture 15 adjacent the top edge thereof for receiving a mating latch formed on the cover 3 as will hereinafter be described. The top of flange 13 is set at an angle to create a camming surface 13*a* for facilitating closing of the case as will hereinafter be described. The side walls 6 are stepped so as to have an upper edge 6*a*, a lower edge 6*b* and a transition area 6*c*.

In one embodiment a thermal plastic rubber protective sleeve 14 is overmolded on the metal case base 2. Sleeve 14 provides shock and vibration protection for the case in the event it is dropped or otherwise bumped. Sleeve 14 does not extend all the way to the upper edge 6*a* or transition area 6*c* such that the exposed portion of the side wall 6 creates a lap joint when the cover 3 is closed. Sleeve 14 defines a recess 16 in the center outer surface of front wall 8 to create a gripping area for the end user that can be gripped by the user when opening the case. The front surface 8 may have a plurality of ridges 20 formed therein to enhance the grip. Other thermal plastic rubber protective sleeves 17 may be overmolded on base 2 in areas susceptible to shock or vibration.

Figure 4:
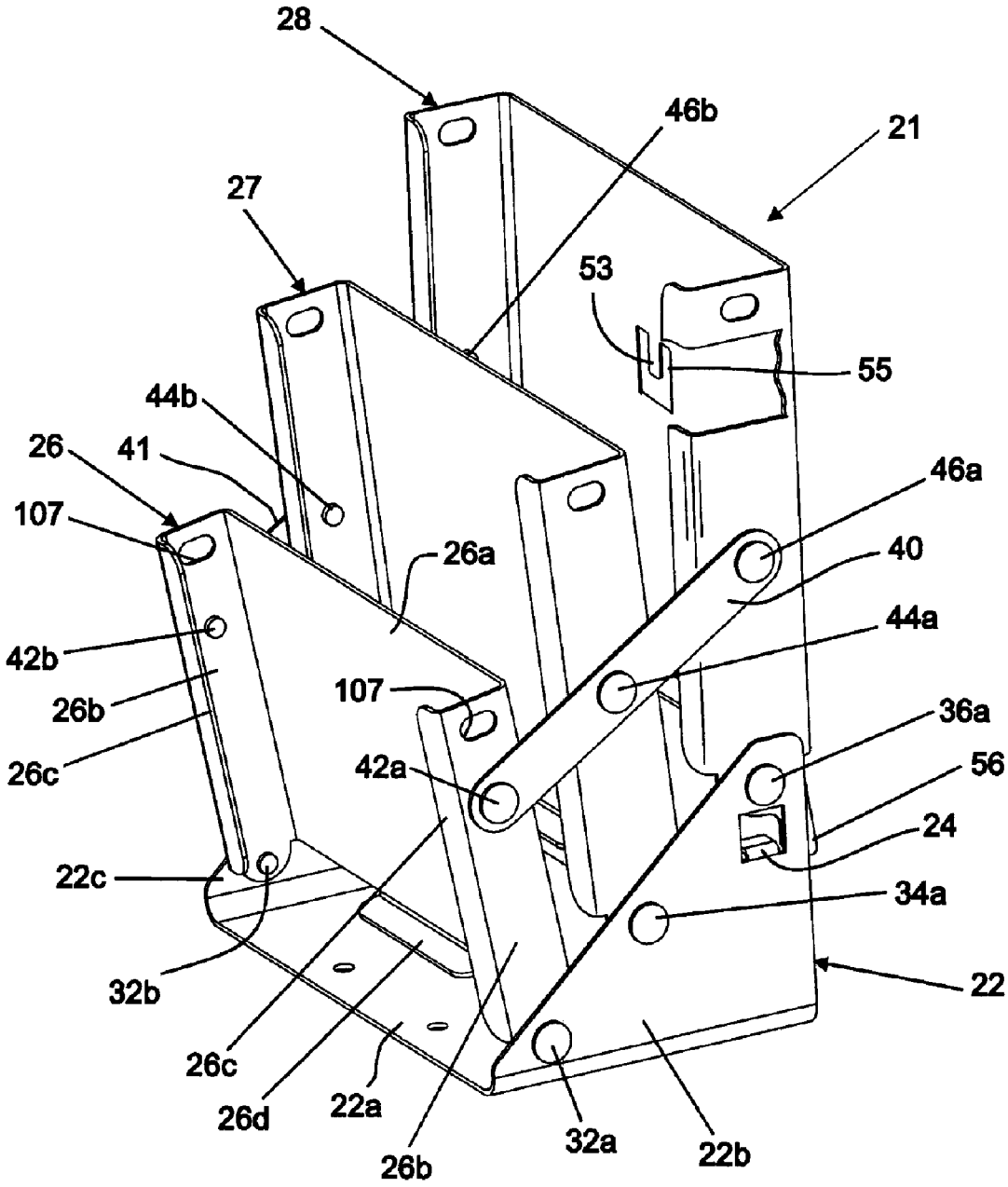
FIG. 4 is a perspective view of the cassette holder used in the storage case of the invention.

A cassette holder assembly 21 is mounted in base 2. As shown in FIG. 4 cassette holder assembly 21 includes a cassette support member 22 having a bottom portion 22*a* fixed to the bottom wall 4 by rivets, screws or the like. A pair of upstanding support arms 22*b* and 22*c* extend from bottom portion 22*a* substantially parallel to side walls 6. A stop member 24 is formed in at least one of the support arms 22*b* and 22*c* to limit the extent of movement of the cassette holders 26, 27 and 28 as will hereinafter be described. The stop member 24 may formed by punching out a tab and bending the tab into the interior of the support arms. Cassette holder 26 consists of a metal sheet formed to have a back wall 26*a* and a pair of side walls 26*b* extending from back wall 26*a*. Retaining lips 26*c* extend a short distance from side walls 26*b* substantially parallel to back wall 26*a*. A bottom lip 26*d* extends a short distance from the lower edge of back wall 26*a* substantially perpendicular thereto. Back wall 26*a*, side walls 26*b*, retaining lips 26*c* and bottom lip 26*d* cooperate to define an interior space for receiving cassette 30. Cassette holders 27 and 28 have the same construction as cassette holder 26 except that cassette holders 27 and 28 may be made increasingly wider and taller to accommodate increasingly larger bits. Cassette holder 27 retains cassette 31 and cassette holder 28 retains cassette 33. The heights of the cassette holders are sized to retain drill bits in a range of sizes. For example, cassette holder 26 may retain drill bits having diameters ranging from 1/16 to 9/32 inches, cassette holder 27 may retain drill bits having diameters ranging from 19/64 to 13/32 inches and cassette holder 28 may retain drill bits having diameters ranging from 27/64 to ½ inches.

Cassette holders 26, 27 and 28 are pivotably connected to support arms 22*b* and 22*c* at opposed pivots 32*a*, 34*a*, 36*a* and 32*b*, 34*b*, 36*b*, respectively. Pivots 34*a,b* are disposed a distance above pivots 32*a,b* and pivots 36*a,b* are disposed a distance above pivots 34*a,b* slightly greater than the width of cassettes holders 26 and 27, respectively, to allow the cassette holders room to pivot relative to one another. The width of the cassette holders is the distance from the outside of retaining lips 26*c* to the outside of back wall 26*a*.

Cassette links 40 and 41 are secured to each side wall of cassette holders 26, 27 and 28 at pivots 42*a*, 44*a*, 46*a* and 42*b*, 44*b*, 46*b*, respectively. Cassette link 40 operates to move the cassette holders 26, 27 and 28 together as a unit. Cassette link 40 is disposed at a 45 degree angle relative to the bottom portion 22*a* of support 22 when the cover is in the fully open position. This allows the cassette holders to pivot from the open position shown in FIG. 1 where the cassette holders 26, 27 and 28 extend out of the base 2 to a closed position. In the closed position cassette holders 26, 27 and 28 pivot together to the right as viewed in FIG. 1 until cassette holder 26 is positioned adjacent to and substantially parallel to bottom wall 4. Cassette holder 27 is disposed adjacent to and substantially parallel to cassette holder 26 and cassette holder 28 is disposed adjacent to and substantially parallel to cassette holder 27. Thus, in the retracted position the cassette holders are essentially stacked on top of one another inside of case 1.

Referring again to FIGS. 1 to 3, a cover link 50 is provided that connects cassette holder 28 to the cover 3. Specifically, link 50 consists of a rigid member that is substantially U-shaped having a base 50*a*, two legs 50*b* and 50*c* extending from base 50. Pins 50*d* and 50*e* extend from the ends of legs 50*b* and 50*c*, respectively. Pins 50*d* and 50*e* are pivotably received in receptacles 53, receptacles 53 being secured to the inside of cover 3. The base 50*a* is connected to the back of cassette holder 28 under finger 53 in slot 55 formed as part of the back of cassette holder 28, allowing the link 50 to both pivot and move transversely relative to the cassette holder 28.

When cover 3 is moved between the open and closed positions relative to base 2, the movement of cover 3 is transferred to cassette holder 28 via link 50. Likewise, cassette link 40 transmits the movement of cassette holder 28 to cassette holders 26 and 27. As a result, when cover 3 is opened cassette holders 26, 27 and 28 will be moved to the position of FIG. 1 where the cassette holders extend from the base 2 substantially perpendicular to the bottom surface 4. Fingers 56 that extend from the sidewalls of cassette holder 28, engage stop members 24 to limit the movement of cassette holder 28 and thereby limit the extent cover 3 opens relative to the base 2. When the cover is closed link 50 moves the cassette holders to the stacked position as previously described.

Cover 3 includes a first cover portion 58 that has a planar top wall 59, a pair of opposed side walls 60 and a back wall 61 extending therefrom. The side walls 60 are stepped so as to have an upper edge 60*a*, a lower edge 60*b* and a transition area 60*c* such that side walls 60 mate with side walls 6. The outer edge of back wall 61 is pivotably connected to the outer edge of back wall 10 of base 2 at hinge 62 such that cover 3 can pivot relative to the base 2. Hinge 62 includes a first series of spaced receptacles 64 formed at the edge of back wall 10 of base 2. Likewise, a second series of spaced receptacles 66 are formed on the edge of back wall 61 of cover portion 58. Receptacles 64 and 66 are spaced so as to interdigitate when cover 3 is aligned with base 2. A hinge pin 68 is inserted into aligned receptacles 64 and 66 such that the receptacles can rotate around pin 68 allowing the cover 3 to be pivoted with respect to base 2. A pair of compression springs 67 and 69 may be mounted on hinge pin 68 with one of the ends thereof contacting cover 3 and the other of the ends thereof contacting base 2 such that the cover is biased to the open position if desired.

Cover 3 further includes a second cover portion 70 that has a planar top wall 71, a pair of opposed side walls 72 and a front wall 73. Top wall is dimensioned such that when second cover portion 70 is disposed on top of first cover portion 58, side walls 72 extend outside of and partially surround side walls 60. Side walls 72 are formed with flanges 75 that are formed by an extension of the side walls bent to create a space between the flanges 75 and the interior surface of side walls 70. The outer edges of side walls 60 are slideably disposed in the space between side walls 72 and flanges 75 such that second cover portion 70 can slide relative to first cover portion 58 but second cover portion cannot move laterally away from first cover portion. A latch member 80 is formed at the outer edge of front side 70*c* of second cover portion 70 and is dimensioned to engage the aperture 15 when the cover is in the closed position and second cover portion is retracted to the locked position.

Figure 8:
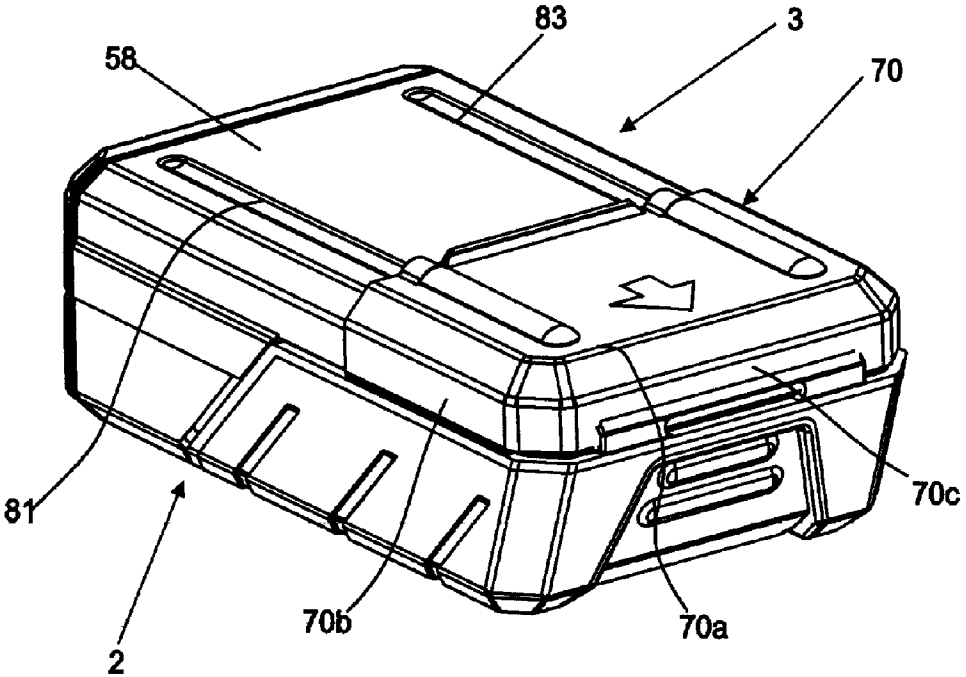
FIG. 8 is a perspective view of the storage case of the invention in the closed position.
Figure 9:
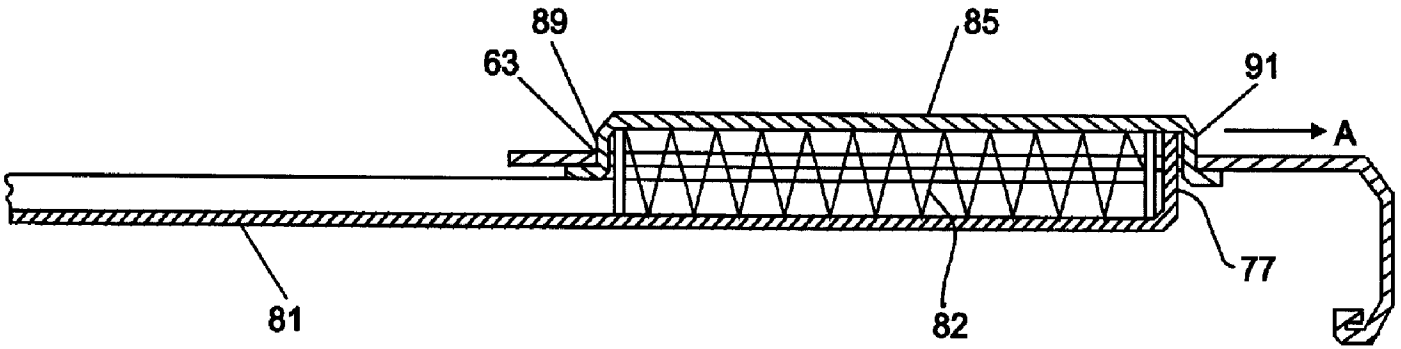
FIG. 9 is a section view showing the engagement between the first cover portion and the second cover portion.

Referring to FIGS. 3, 8 and 9 first cover portion 58 has a pair of parallel grooves 81 and 83 formed on the outer surface of top wall 71. Grooves 81 and 83 extend in the direction of travel of second cover portion 70. Lips 77 and 79 are formed at the ends of grooves 81 and 83. In one embodiment the lips 77 and 79 are formed by bending a portion of top wall 59 at right angles to the plane of the top wall. Slots 63 and 65 are formed in top wall 71 of second cover portion 70 so as to be coextensive with grooves 81 and 83. Compression springs 82 and 84 are located within slots 71 and 73 such that they are disposed in grooves 81 and 83, respectively. Caps 85 and 87 are snap fit into slots 71 and 73 and over springs 82 and 84, respectively, to cover the springs. The caps may also be attached with adhesive, sonic welding or a combination of attachment devices.

The operation of the two piece cover will be described with specific reference to FIG. 9 showing one of the spring arrangements it being understood that the other spring arrangement is identical. One end of spring 82 abuts lip 77 and the other end of spring 82 abuts the end 89 of cap 85 such that the spring is under compression. When the second cover portion 70 is extended from the first cover portion 58 in the direction of arrow A, spring 82 is further compressed between lip 77 and cap 85. Spring 82 exerts a force on the cover second portion 70 tending to move it in the retracted position opposite arrow A. The cover can retract until lip 77 abuts the end 91 of cap 85.

The biasing of second cover portion 70 relative to first cover portion 58 creates two effects. First, when the cover is in the closed position relative to base 2 as best shown in FIG. 8, latch 80 will be biased into engagement with aperture 15 thereby locking the cover in the closed position. The case can be opened by extending second cover portion 70 relative to first cover portion 58 and removing latch 80 from the slot.

The second effect is that when the cover is moved to the open position shown in FIGS. 1 and 2, the second cover portion 70 may be biased to a further retracted position to thereby move cover 3 down (as viewed in FIG. 1) to create space to facilitate the extraction and insertion of bits from and into case 1. The extent to which second cover portion 70 retracts may be varied by varying the length of first cover portion 58 and/or the length of slots 63 and 65. The cover can be retracted to the extent desired provided that the second cover portion, when in its extended position, extends far enough for latch member 80 to engage aperture 15. Thus the second cover portion may be moved between a first position where it is extended and unlocked from base, a second position where the case is closed and locked and a third position where the second cover portion is retracted beyond the second position and out of the way of the drill bits when the cover is open.

In one embodiment in the third position the second cover portion is only retracted to the extent that cover 3 has the same length as base 2. In this position latch member 80 is disposed over wall 8 as the cover 3 is moved to the closed position. The cover 3 can then be closed by exerting a downward force on the cover until latch 80 hits camming surface 13*a* such that the second cover portion is extended far enough to allow latch 80 to pass outside of front wall 8 and engage aperture 15. Springs 82 and 84 retract latch member 80 into aperture 15 to securely lock the cover closed.

To retain the drill bits in the cassette holders, a plurality of cassettes 30, 31 and 33 are provided. Referring to FIGS. 5, 6 and 7, specific reference is provided to cassette 30 it being understood that all of the cassettes have the same basic construction. Cassette 30 may be made of molded plastic and has a front wall 30*a* and opposing side walls 30*b*, and bottom wall 30*c* extending from the front wall. The front wall 30*a*, side walls 30*b* and bottom wall 30*c* are dimensioned such that the cassette is closely received in cassette holder 26. Specifically, the cassette can be slidably inserted into the cassette holder. Extending between the side walls is a bit retaining wall 30*d* having a plurality of apertures 90 formed therein for receiving the drill bits. The apertures 90 are dimensioned to correspond to specific size bits where the apertures freely but closely receive a bit. An apron 91 extends down from bit retaining wall 30*d* and includes curved sections 91*a* arranged with one cured section coextensive with the inner wall of each of apertures 90. The apron helps to guide the bits into and retain the bits in the cassettes.

In one embodiment, the bit size 98 is molded into the inclined surface 97 of bit retaining wall 30*d* adjacent each aperture identifying the size of bit retained in that aperture. Placing the bit sizes on the inclined surface makes recognition of the bit size easier for the user. Front wall 30*a* does not extend all the way to bit retaining wall 30*d* to create a window 92 such that the bits are visible to an end user when retained in cassette 30.

Because cassette holder 26 forms a back wall for cassette 30, cassette 30 may be formed without a back wall and the back of the cassette may be left open as shown in the illustrated embodiment. To securely retain the bits in the cassettes, bottom wall 30*c* is formed with an inclined camming surface 95. Camming surface 95 is oriented such that when a bit is inserted into one of apertures 90, the inserted end of the bit engages camming surface 95 such that the end of the bit is forced toward the front of the cassette. As the inserted end of the bit is forced forward, the opposite end of the bit is forced rearward until it contacts the back portion of inner wall of aperture 90. The frictional engagement of the bit with the camming surface 95 and inner wall of aperture 90 retains the bits in the cassettes.

Extending from the upper ends of both of side walls 30*b* in the area of bit retaining wall 30*d* are cassette locking members 100, each of which have a flexible L-shaped finger 101 extending from the side walls such that portion 102 of finger 101 extends adjacent to the outside surface of side walls 26*b* when the cassette is inserted in the cassette holder. An interior surface of portion 102 has a protrusion 105 formed thereon that extends into mating apertures 107 formed on the side walls 26*b* of cassette holder 90 when the cassette is fully inserted. The engagement of protrusion 105 with aperture 107 locks the cassettes into the cassette holders. A pressure pad 106 is formed on a surface of portion 102 opposite protrusion 105. Pressure pad 106 is arranged such that a pressure exerted on pad 106 will deform finger 101 and remove protrusion 105 from aperture 107. The opposing pressure pads on the same cassette can be gripped between the thumb and a finger of one hand and squeezed to exert pressure on both pads of a cassette simultaneously. The cassette can thereby be easily removed with one hand. To reinsert the cassette, the cassette is slid back into the cassette holder until protrusions 105 engage apertures 107. Thus the cassettes can be removed from the case if the user only needs access to selected sizes of bits contained in one of the cassettes. The cassette can be carried in a pocket or workbelt such that the drill bits can be removed and replaced on the work site without the need to carry the entire case. This will eliminate the loss of individual drill bits. Cassettes 31 and 33 have the same construction as cassette 30 except that cassettes 31 and 33 may be made increasingly wider and longer to accommodate larger bit sizes. The outside dimensions of the cassettes allow the cassettes to be closely but freely inserted into the cassette holders.

While embodiments of the invention are disclosed herein, various changes and modifications can be made without departing from the spirit and scope of the invention. The scope of the invention is indicated in the appended claims, and all changes that come within the meaning and range of equivalents are intended to be embraced therein.

What is claimed is:

1. A case comprising:

a base;

a cover secured to the base to selectively close or open the case;

said cover having a first cover portion and a second cover portion, secured to the first cover portion such that said first cover portion is slidable relative to said second cover portion between a first position, a second position and a third position, wherein said first cover portion when in said first position engages said base to fix said cover relative to said base and when in said second position extends from said second cover portion a distance greater than when in said first position and when in said third position extends from said second cover portion a distance less than in said first position, said cover being open when said first cover portion is in the third position.

2. The case of claim 1 wherein the first cover portion is biased relative to the second cover portion.

3. The case of claim 2 wherein the first cover portion is biased toward the third position.

4. The case of claim 3 wherein the holder removably retains a cassette, said cassette including means for retaining a tool.

5. The case of claim 1 further including a holder for articles mounted in the base for movement relative to the base between a retracted position where the holder is substantially contained within the base and access to the articles is prevented and an extended position where the holder extends from the base allowing access to the articles.

6. The case of claim 5 wherein the holder includes at least two article holders, each article holder being pivotably retained in said base and movable relative to the base between the retracted position where the holders are substantially contained within the base and access to the articles is prevented and an extended position where the holders extend from the base allowing access to the articles.

7. The case of claim 6 wherein when in the retracted position the one of the at least two holders is positioned between the base and the other of the at least two holders.

8. The case of claim 6 wherein the at least two holders are connected by a link such that the at least two holders pivot together.

9. The case of claim 5 wherein the holder is connected to the cover for simultaneous movement by a link.

10. The case of claim 5 wherein the holder pivots relative to the base.

11. The case of claim 1 wherein when the first cover portion is in the third position it facilitates access to the interior of the case.

12. A drill bit case comprising:

a base;

a cover secured to the base to selectively close or open the case;

said cover having a first cover portion and a second cover portion, said first cover portion being slidable relative to said second cover portion between a first extended position and a second retracted position wherein the second cover portion is biased relative to the first cover portion toward the second retracted position;

a holder for articles mounted in the base for movement relative to the base between a first position where the holder is substantially contained within the base and access to the articles is prevented and a second position where the holder extends from the base allowing access to the articles where said holder is in the second position when said first cover portion is in the second retracted position, said holder moving from the first position to the second position when the cover is opened; and a cassette removably retained in the holder.

13. A drill bit storage case comprising:

a base;

a cover pivotably secured to the base to close or open the case;

said cover having a first cover portion and a second cover portion, said second cover portion being slidable relative to said first cover portion between a partially retracted position and a fully retracted position wherein the second cover portion is biased toward the partially retracted and fully retracted positions;

a holder for articles mounted in the base for movement relative to the base between a first position where the holder is substantially contained within the base and access to the articles is prevented and a second position where the holder extends from the base allowing access to the articles; and a cassette removably retained in the holder.

14. The drill bit storage case of claim 13 wherein the cassette includes a plurality of apertures, each of said plurality of apertures receiving a drill bit, and a camming surface for moving the bit into engagement with an inside surface of said each of said plurality of apertures.

15. The drill bit storage case of claim 13 wherein the cassette includes a pair of locking members, said locking members being disposed so as to be simultaneously engaged by the thumb and fingers of a hand such that the cassette can be removed from the holder.

16. The drill bit storage case of claim 13 wherein when the cover is closed, the second cover portion is in the partially retracted position and engages the base to lock the cover to the base.

17. The drill bit storage case of claim 13 wherein said second cover portion is moved to an extended position to disengage the second cover portion from said base.

18. A drill bit case comprising:

a base;

a cover secured to the base to selectively close or open the case;

said cover having a first cover portion and a second cover portion, said first cover portion being slidable relative to said second cover portion between a first extended position and a second retracted position wherein the first cover portion is biased relative to the second cover portion toward the second retracted position;

a holder for articles mounted in the base for movement relative to the base between a first position where the holder is substantially contained within the base and access to the articles is prevented ands a second position where the holder extends from the base allowing access to the articles, said holder moving from the first position to the second position when the cover is opened; and a cassette removably retained in the holder.

* * * * *